US008490443B2

(12) United States Patent
Gokcebay

(10) Patent No.: US 8,490,443 B2
(45) Date of Patent: Jul. 23, 2013

(54) ELECTRONIC LOCK FOR CABINET DOORS, DRAWERS AND OTHER APPLICATIONS

(75) Inventor: Asil T. Gokcebay, Petaluma, CA (US)

(73) Assignee: Security People, Inc., Petaluma, CA (US)

( * ) Notice: Subject to any disclaimer, the term of this patent is extended or adjusted under 35 U.S.C. 154(b) by 661 days.

(21) Appl. No.: 12/214,357

(22) Filed: Jun. 17, 2008

(65) Prior Publication Data

US 2009/0249846 A1 Oct. 8, 2009

Related U.S. Application Data

(63) Continuation-in-part of application No. 11/809,172, filed on May 30, 2007.

(60) Provisional application No. 60/810,195, filed on May 31, 2006.

(51) Int. Cl.
*E05B 49/00* (2006.01)

(52) U.S. Cl.
USPC ..... 70/78; 70/214; 70/278.1

(58) Field of Classification Search
USPC ..... 70/78, 278.1, 127, 447, 91, 214; 292/197, 292/257, 164–165, 198
See application file for complete search history.

(56) References Cited

U.S. PATENT DOCUMENTS 2,046,630 A 7/1936 Jacobi
3,455,127 A 7/1969 Simon
3,753,164 A 8/1973 DeVries
3,754,164 A 8/1973 Zorzy
3,754,213 A 8/1973 Morroni et al.
3,831,065 A 8/1974 Martin et al.
3,878,571 A 4/1975 Wagner
4,243,256 A 1/1981 Frydrych
4,495,540 A 1/1985 Remington et al.
4,568,998 A 2/1986 Kristy
4,665,397 A 5/1987 Pinnow
4,748,833 A * 6/1988 Nagasawa ..... 70/214
4,887,445 A 12/1989 Beatty
4,901,545 A * 2/1990 Bacon et al. ..... 70/278.3
4,931,789 A 6/1990 Pinnow
4,956,984 A * 9/1990 Chi-Cheng ..... 70/277
4,967,305 A 10/1990 Murrer et al.
5,020,345 A 6/1991 Gartner et al.
5,021,776 A 6/1991 Anderson et al.
5,033,282 A 7/1991 Gartner et al.
5,153,561 A 10/1992 Johnson
5,223,829 A 6/1993 Watabe
5,321,963 A 6/1994 Goldman
5,373,718 A 12/1994 Schwerdt et al.
5,461,218 A 10/1995 Castleman et al.
5,564,294 A 10/1996 Chen
5,845,523 A 12/1998 Butterweck et al.
5,886,644 A 3/1999 Keskin et al.
5,894,277 A 4/1999 Keskin et al.
6,116,066 A 9/2000 Gartner et al.
6,209,367 B1 * 4/2001 Hyatt et al. ..... 70/278.2
6,331,812 B1 12/2001 Dawalibi (Continued)

*Primary Examiner* — Kristina Fulton
(74) *Attorney, Agent, or Firm* — Thomas M. Freiburger

(57) ABSTRACT

An electronic lock replaces mechanical locks in cam lock, cabinet lock and switch lock applications, as well as other locks for file cabinets, desk and cabinet drawers, access panels and other secure situations that often utilize relatively simple lock mechanisms. In a preferred embodiment the lock is without a keypad, accessed by an electronic key making contact with a terminal.

20 Claims, 10 Drawing Sheets

U.S. PATENT DOCUMENTS

| | | | | |
|---|---|---|---|---|
| 6,347,486 | B1 | 2/2002 | Badillet | |
| 6,655,180 | B2 | 12/2003 | Gokcebay et al. | |
| 6,791,450 | B2 | 9/2004 | Gokcebay et al. | |
| 6,989,732 | B2 | 1/2006 | Fisher | |
| D520,340 | S * | 5/2006 | Freck | D8/343 |
| 7,336,150 | B2 * | 2/2008 | Gokcebay et al. | 340/5.54 |
| 7,469,564 | B1 * | 12/2008 | Shaw | 70/283 |
| 7,516,633 | B1 * | 4/2009 | Chang | 70/472 |
| 2003/0024288 | A1 | 2/2003 | Gokcebay et al. | |
| 2006/0076385 | A1 | 4/2006 | Etter et al. | |
| 2006/0150694 | A1 * | 7/2006 | Frolov et al. | 70/277 |
| 2007/0056339 | A1 | 3/2007 | Irgens et al. | |
| 2007/0090921 | A1 | 4/2007 | Fisher | |
| 2007/0169525 | A1 * | 7/2007 | Chang | 70/472 |
| 2007/0277571 | A1 | 12/2007 | Gokcebay | |

* cited by examiner

ELECTRONIC LOCK FOR CABINET DOORS, DRAWERS AND OTHER APPLICATIONS

This application is a continuation-in-part of application Ser. No. 11/809,172, filed May 30, 2007, which was a regular filing from provisional application No. 60/810,195, filed May 31, 2006. The disclosure of that copending application is incorporated here in its entirety.

BACKGROUND OF THE INVENTION

This invention concerns locks for cabinets, lockers, drawers, access panels and similar situations. Specifically the invention embraces an electronic cam lock that fits standard cam lock openings.

Metal and wood file cabinets, desk and cabinet drawers, locker doors, access panels and doors, mail boxes, dispensers and other secure situations often utilize relatively simple lock mechanisms known as cam locks. Such cam locks may or may not involve a camming action. In some cases they move other mechanisms that are engaged with the door or drawer of the cabinet or engaged with other mechanisms that are linked to the door and drawer of the cabinet or multiple doors or drawers of the cabinet. In one of the simplest forms, a cam lock on a cabinet door typically fits in a ¾ inch diameter D-shaped or double D-shaped hole and, at the back side of the cam lock cylinder unit, has a metal blade or arm called a cam that rotates when the key is turned, from a position disengaged from surrounding cabinet hardware to a position of engagement in a slot or behind a ledge of the surrounding cabinet hardware. Other locks, such as those for desk drawers, commonly referred as cabinet locks, involve a camming type action as the key and plug are rotated. The rotation causes a cam or nipple to move a deadbolt linearly to a locking or unlocking position or in the case of a spring loaded latch or deadlatch the rotation causes the cam or nipple to move a latch or deadlatch to unlocking position and removing the key keeps the latch or deadlatch in the extended locked position.

Metal filing cabinets often utilize cam locks, or a variation known as a plunger type lock in which a spring loaded plunger/lock cylinder located in the top horizontal margin of the cabinet, when pushed in, will lock all drawers. The use of a key releases the spring plunger to return to the outward position and unlock the drawers.

Locker and cabinet locks have included electronic locking devices, some of which utilized keypads and some of which utilized IButtons or other ID or non-volatile memory devices which work on contact to release the lock. See, for example, U.S. Pat. Nos. 5,894,277, 5,886,644, 6,655,180 and 6,791,450. The disclosures of all of these patents are incorporated herein by reference.

There is a need for a relatively simple, easily used, reliable and compact electronic lock, with a keypad but optionally operable by an electronic key, or both, for situations in which typically cam, plunger and cabinet locks were employed, and capable of fitting in a standard opening or bore of a standard cam, plunger or cabinet lock cylinder in a cabinet, door, access panel, mail box, dispenser, etc. and alternatively capable of fitting in a standard shell of a standard cam, plunger or cabinet lock cylinder in a cabinet, door, access panel, mail box, dispenser, etc. This is an objective of the current invention described below.

SUMMARY OF THE INVENTION

The invention addresses these needs with a low profile and very compact electronic lock that, in one application, fits in the top one inch horizontal margin of a steel file cabinet. The compact electronic locking device in one embodiment has a knob or handle that can rotate the cam lock cylinder plug when such manual rotation is permitted by the lock electronics. A keypad for entry of a code may be included, and if so, the code can be either permanently set to a reprogrammable code, or set in each case by a temporary user, who can then input the same code to lock and unlock the lock, this feature depending on circumstances and function desired.

In one preferred embodiment particularly adapted for a file cabinet, the locking device in one embodiment is less than one inch in height (about ⅞ inch), about two inches in length and roughly about ½ inch in depth or thickness (or about ½ to ⅝ inch), as to the housing of the device. A cam locking device of this size will fit unobtrusively on the surface of the horizontal top margin area of a steel file cabinet. The housing may contain several small battery cells, such as two AAA batteries, but preferably smaller batteries such as coin cell or button-type batteries for further reduction of housing size. From the back of the housing in one embodiment extends the cam lock cylinder unit of conventional cam lock size, and with a length to fit the application, i.e. the depth of material and configuration where mounted. The rear-extending cylinder unit preferably has an external thread, and a nut or threaded ring is tightened down to firmly retain the cylinder and housing in place. In other embodiments a dummy plug can extend back from the housing unit, or simply a driver or spindle. Since the cam lock opening in the cabinet or door or panel will typically be the conventional D-shaped opening or double D-shaped opening, the housing is fixed in place against rotation by this configuration. However, another fastening location(s) may be included, such as a machine screw assembled from the back and through a hole in the drawer or panel, engaging in a threaded hole provided in the housing, or screw posts extending from the back of the housing. This threaded hole or screw post is preferably is at an opposite end of the housing from the location of the cylinder and turning knob or handle. There may be more than one threaded hole or screw post depending on the mounting preferences. In an alternative configuration, the housing back can simply have a nipple that extends in a hole formed in the cabinet, drawer or door, or a hook-shaped element that extends from the back of the housing and engages firmly in the hole, particularly for relatively thin metal cabinets.

It is an important feature of the invention that the electronic lock device be compact and relatively simple, at least as to mechanical elements, and without any further electronics or housing required at the back side of the door or panel. Essentially the only element at the back side of the door, drawer or panel is the rear-extending cam or cabinet lock cylinder unit or actuator, an actuator, latch or cam positioned to engage with a ledge or slot or other hardware to retain the door(s) or panel locked. In some embodiments the rear-extending element is a dummy plug or a driver. An alternative form of the lock still comprises a single housing but is positioned at the back side of the panel, drawer, etc., in a through-the-panel mounting with only the knob or handle and the access terminal or keypad extending through the panel.

In one preferred form, the invention is embodied in a compact housing containing electronics and having an electronic key receptacle for entry of codes by a user, a cam cylinder unit or driver extending from a back side of the housing, in a standard cam lock size adapted to fit through a standard cam lock opening in a cabinet or door for extending therethrough, and with a knob or handle on the housing for operating the cam lock manually when permitted by the electronics. A battery compartment in the housing, accessible from the front of the cabinet, contains one or more battery cells for operating the electronics.

In another preferred form, the invention is embodied in a cam lock for a door, cabinet or drawer and includes a compact housing containing electronics and having an electronic key receptacle for entry of codes by a user, a plug of the cam, plunger or cabinet lock cylinder unit extending from a back side of the housing that matches the size and shape of the cam lock shell already mounted on the door, cabinet or drawer, and with a knob or handle on the housing for operating the cam lock manually when permitted by the electronics. Again, a battery compartment in the housing, accessible from the front of the cabinet, contains one or more battery cells for operating the electronics.

In another preferred form, the invention is embodied in a cam lock for a door, cabinet or drawer and includes a compact housing containing electronics and having an electronic key receptacle for entry of codes by a user, a specially shaped driver unit extending from a back side of the housing that matches an opening on the plug of the cam cabinet or drawer, a lock shell already mounted on the door, and with a knob or handle on the housing for operating the cam lock manually when permitted by the electronics. Again, a battery compartment in the housing, accessible from the front of the cabinet, contains one or more battery cells for operating the electronics.

In another preferred form, the invention is embodied in a cam lock for a door, cabinet or drawer mountable from back of the door, cabinet or drawer such that only the user interface extends through the face of the door, cabinet or drawer and includes a compact housing containing electronics and having an electronic key receptacle and in some cases, a keypad for entry of codes by a user, a specially shaped driver unit extending from a back side of the housing that matches the end of a cam lock or cam lock plug of the typical mechanical lock for engaging with a strike or other locking bars, cams or apparatus, and with a knob or handle on the housing for operating the cam lock manually when permitted by the electronics. A battery compartment in the housing, accessible from the back of the lock, contains one or more battery cells for operating the electronics.

In another preferred form, the invention is embodied in a cam lock for a door, cabinet or drawer mountable from back of the door, cabinet or drawer such that only the user interface extends through the face of the door, cabinet or drawer and includes a compact housing containing electronics and having an electronic key receptacle and an RF reader or wireless reader or IButton reader for entry of a code by a user, a specially shaped driver unit extending from a back side of the housing that matches the end of a cam lock or cam lock plug of the typical mechanical lock for engaging with a strike or other locking bars, cams or apparatus, and with a knob or handle on the housing for operating the cam lock manually when permitted by the electronics.

In another preferred form the lock devices are fitted with an RJ45 jack or wireless antenna for network connectivity and external power.

It is therefore among the objects of the invention to improve over prior cam and cabinet locks, with an electronic cam lock that can be retrofitted to existing cam lock, cabinet lock, switch lock or plunger lock openings in doors, drawers, access panels, mail boxes, dispensers, etc. as well as provide an improved locking solution for new applications wherein the internal locking systems for locking multiple points are configured to receive a cam, plunger or cabinet lock. The device is relatively simple, compact and unobtrusive. These and other objects, advantages and features of the invention will be apparent from the following description of preferred embodiments, considered along with the accompanying drawings.

DESCRIPTION OF PREFERRED EMBODIMENTS

Figure 1:
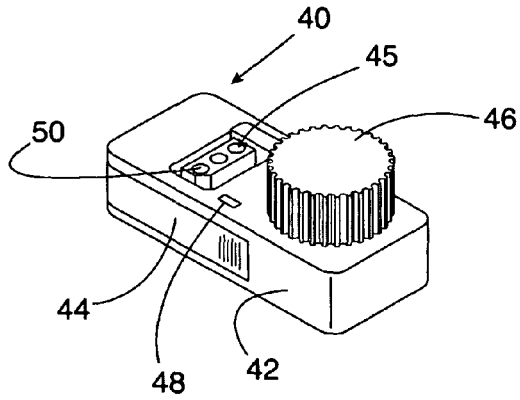
FIG. 1 is a perspective view showing an electronic cam type lock of the invention, for a cam lock and similar functions, with a receptacle for electronic input and without a keypad.
Figure 2:
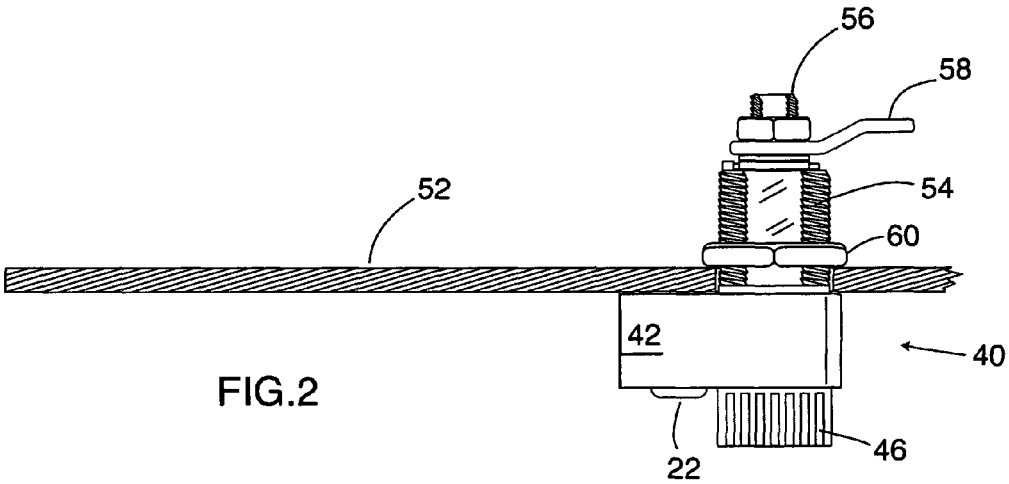
FIGS. 2 and 3 are sectional plan and elevation views showing the lock device of FIG. 1.
Figure 3:
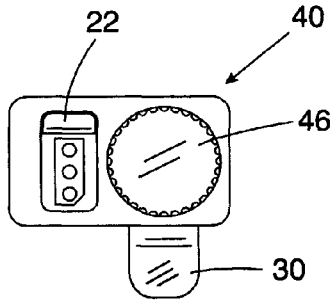

FIGS. 1-3 show a lock 40 according to the invention. The lock 40, which has a housing 42, preferably has batteries within a battery compartment 44 shown on a side of the unit, and a terminal 45 is also included. The lock unit 40 is the sole electronic housing for a lock, and may be part of a cam lock or cabinet lock, as well as a locker lock or a driver for any kind of lock or key switch mechanism which is mounted on a panel behind the lock 40. All of the drawings show different forms of this compact electronic lock unit.

The lock 40 has a rotatable knob or handle 46 extending from the housing 42 (the handle could be a lever if required or desired). The lock 40 is preferably without a keypad but in other respects is preferably very similar to the lock shown in copending application Ser. No. 11/809,172. The lock unit 40 is very compact and if it has onboard batteries they can be small standard cells or coin cell type batteries. A status indicator light is shown at 48.

The lock is operated using a key device such as that shown in copending application Ser. No. 12/072,557, as well as U.S. Pat. No. 7,336,150, and the disclosure of both are fully incorporated herein by reference. The key device preferably has batteries and makes contact with the electrical contacts 50 shown in the terminal 45 at the front side of the housing. The lock unit 40 can be without batteries; if it does have onboard batteries within the housing 42 (within the compartment 44 shown in FIG. 1), then a set of key devices for the lock, or for a series of similar locks, can include small key contact devices having no battery and having two contacts for engagement with two of three contacts 50 shown in the terminal 45 on the lock. A master or manager's key device can be somewhat larger, with onboard batteries carried in the key device, with three contacts for engaging with all three of the contacts 50 in the terminal 45. This enables a manager to use the special key to provide jump power to the lock 40 in a case where the lock's battery is low or when a user of the lock has forgotten his key or the key is somehow nonfunctional, or for both situations simultaneously. The terminal 45, and the contacts on the key, can be structured in accordance with the drawings and description of copending application Ser. No. 12/072,557, as well as U.S. Pat. No. 7,336,150, for protection of the contacts of both the lock and the key and to ensure proper engagement.

FIGS. 2 and 3 show one form of the lock 40 in a side or top elevation view, installed in FIG. 2 in a panel 52 such as on a door, file cabinet, drawer, locker door, or other type of application. In FIGS. 2 and 3 the lock is essentially in the configuration of a cam lock, wherein the handle or knob 46 connects directly with a cam lock cylinder unit (without tumbler pins or wafers) 54; specifically, the handle 46 turns a moveable member, e.g. a rotatable bolt or core 56 which rotates within the fixed cylinder unit 54 when permitted by the electronics. FIG. 2 shows one example of latching with the cam lock device, with a metal arm or cam 58 rotatable with the bolt 56, to be rotated using the handle 46 when permitted. A nut or threaded ring 60 retains the lock unit to the panel 52, in a position such that the arm or cam or latch 58 engages behind a ledge or in a slot or other appropriate element when the door, drawer, locker door, etc. is to be in a locked condition.

The lock unit 40 is extremely compact and can have dimensions of, for example, about two inches in width (the horizontal direction as seen in FIG. 3); about ⅞ inch in height (the vertical direction in FIG. 3); and about ½ inch in thickness. More broadly the size is in the range of about 1½ to 3 inches wide, about ⅞ to 1⅛ inch in height and about ⅜ to 1 inch thick.

Figure 4A:
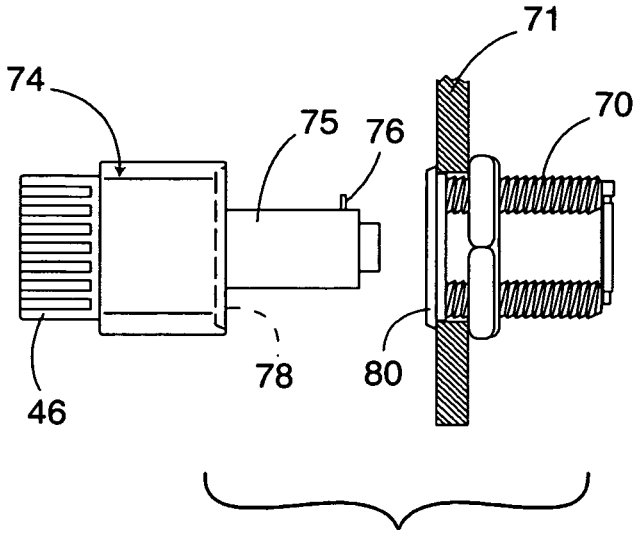
FIGS. 4A and 4B are partially sectioned side elevation views showing a modified lock device as fitted into an existing cam lock or similar situation.
Figure 4B:
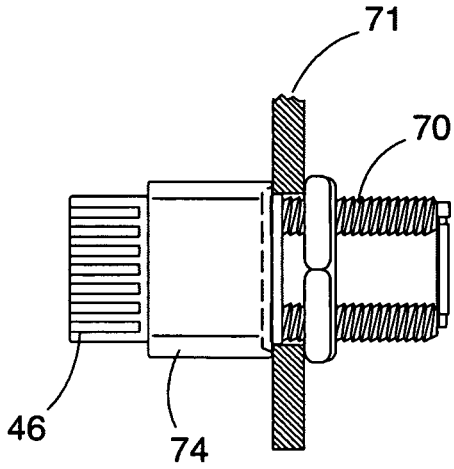

FIGS. 4A and 4B show a typical cam lock shell 70 mounted on a door or drawer 71, with the typical cam lock plug removed, and replaced with an electronic lock 74 with a cylinder plug 75, retrofitted into the shell 70 in accordance with the invention. The plug 75 is a "blank" plug that will operate the lock when installed via a retainer clip or pin 76, with the electronics as discussed above to control access. In FIG. 4A the electronics housing 74 has a recess 78 shown in dashed lines, surrounding the extending plug 75, for the purpose of accommodating the slightly protruding face 80 of the cylinder shell 70 as installed in the drawer or door 71. Many cam locks used in furniture have this type of front loaded plug which can also be removed for service and re-keying purposes. This is similar to what is shown in copending Ser. No. 11/809,172, but with the more compact electronic lock unit of the type shown in FIGS. 1-3. This continuation is advantageous in applications where an existing mechanical lock is fitted to the cabinet that has a brand-specific cam device or other linkages that are attached to the cam device for operating multiple drawers or doors.

Figure 5A:
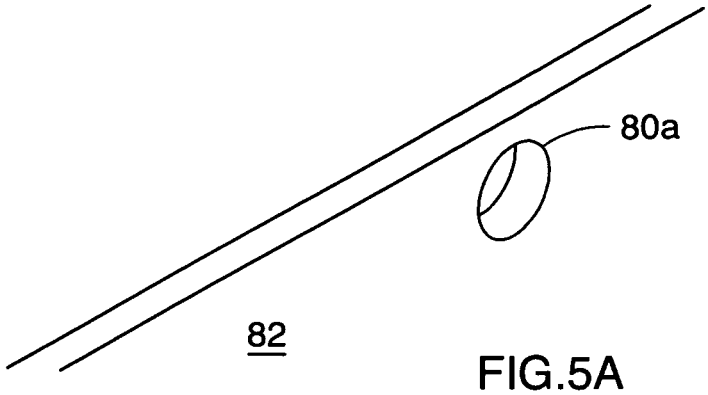
FIGS. 5A, 5B and 5C are perspective views showing a drawer or door panel having provision (a hole) for a cam lock or cabinet lock; an embodiment of a cam lock of the invention, and the cam lock as installed in the panel.
Figure 5B:
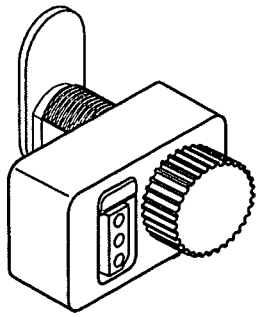
Figure 5C:
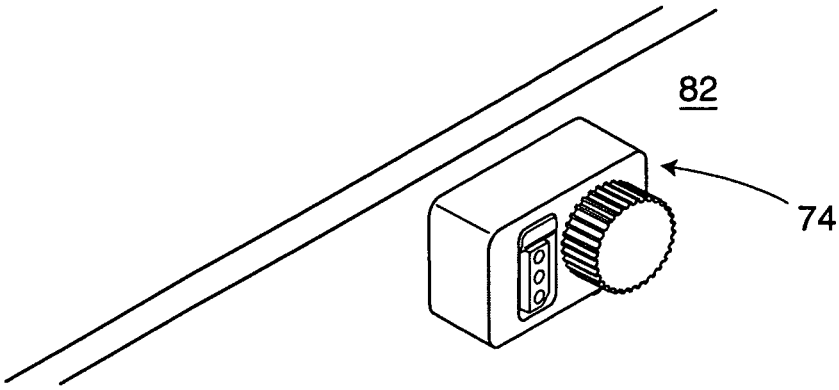

FIG. 5A shows the door or drawer front 82 with a lock mounting hole 80*a*. This hole may be round as shown or a single or double "D" shape commonly used in the industry. The mounting can be similar to FIGS. 2 and 3. FIGS. 5A-5C show a panel, drawer or door 82 with a conventional cam lock removed. FIG. 5B shows the compact self-contained electronic lock 74 of the invention as a replacement installed through the hole 80*a* in the same manner as the mechanical lock it replaces.

Reference is made to copending application Ser. No. 11/809,172 regarding other applications of the electronic lock generally as shown in FIGS. 1-3 and FIGS. 4A and 4B herein. The compact lock of the invention can be formed with a cylinder plug type rear extension that fits into an existing cabinet lock with bolt or latch of the types as shown, for example, in FIGS. 9-12 of that copending application.

Figure 6:
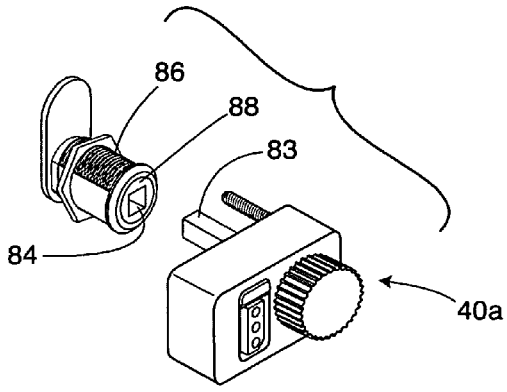
FIG. 6 is a perspective view, exploded, showing a lock device of the invention and indicating its installation into a modified cylinder device of a cam lock or cabinet lock.
Figure 13:
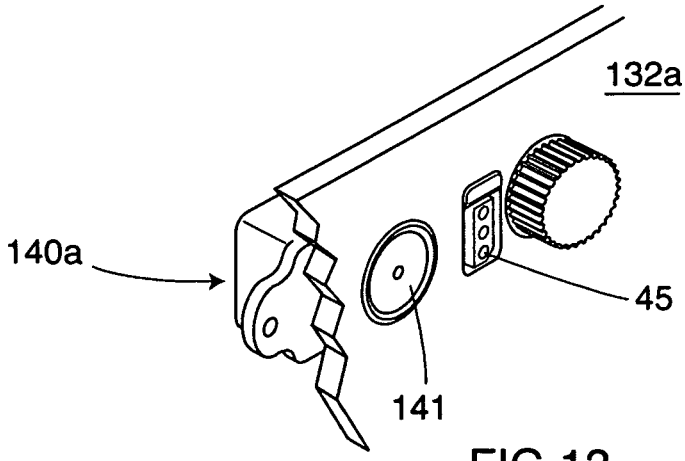
FIG. 13 is the same lock device shown in FIG. 11 but configured for mounting through the panel of a door, cabinet or drawer.
Figure 14:
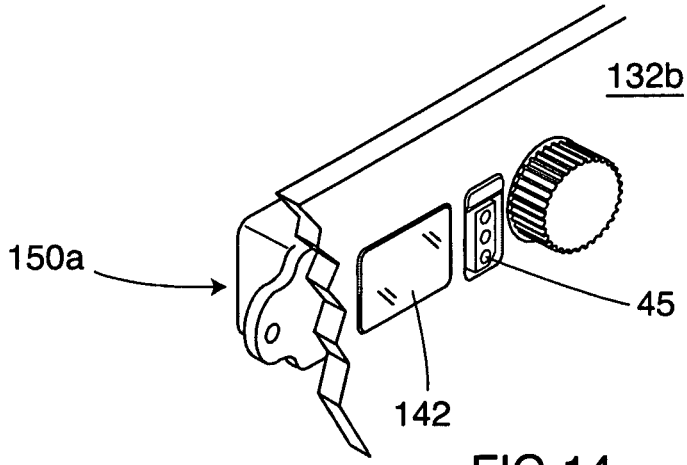
FIG. 14 is the same lock device shown in FIG. 12 but configured for mounting through the panel of a door, cabinet or drawer.

FIG. 6 shows another application of the compact lock of the invention, similar to that of FIGS. 13-14 of copending application Ser. No. 11/809,172. Here, a compact electronic lock 40*a* operates similarly to the lock 40 of FIGS. 1-3 but has a simple spindle or driver 83 extending back from the rear of the unit, essentially straight and perpendicular to the back of the unit and having, for example, a square cross sectional shape. The driver 83 fits in driving contact with a similarly shaped driver hole or receiving socket 84 in a cam lock or lock unit 86. The receiving socket 84 is in a rotatable plug 88 of the lock unit 86. As discussed above, it should be understood that any slide-in keyed cross-sectional shape can be employed for the driver 83, square being one example but also including flat, star-shaped, splined, hex, D-shaped, etc. The lock shown in FIG. 6 is an alternative to other lock arrangements such as FIGS. 4A-4B wherein a dummy cylinder plug is the element that extends to the rear of the electronic lock unit.

Figure 7:
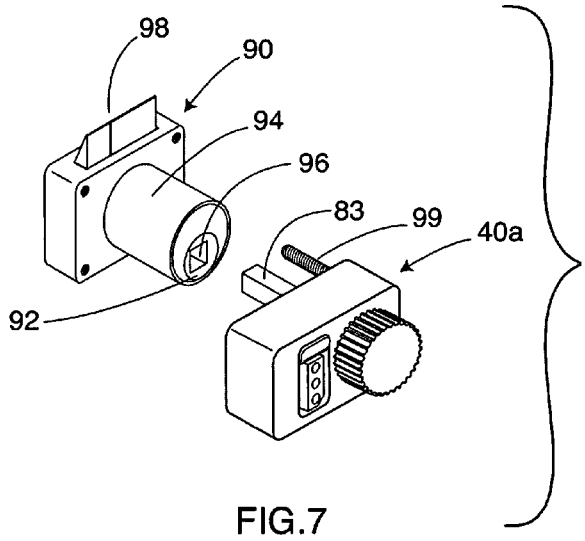
FIG. 7 is a view somewhat similar to FIG. 6, but showing the device being fitted with a pin/tumbler cylinder of a cabinet lock and with a spring latch.

FIG. 7 shows another application of the compact electronic lock unit 40*a*, with the specially shaped driver 83 positioned for assembly into a different type of lock, in this case a cabinet lock 90 of the type that has an off-center rotatable plug 92, a replacement for a conventional cabinet lock device having internal pins and tumblers that act between the plug 92 and the cylinder shell 94. Here, the driver 83 extends into a complementary hole 96 in the rotatable plug 92. Note that the drawing shows a retractable spring latch or dead latch 98 in this embodiment, but instead there could be deadbolt. This is similar to an embodiment described in copending Ser. No. 11/809,172, but with the abbreviated and compact electronic lock 40*a* of the invention. As explained in the copending application, this application of the lock provides for more universal connections and standard provision of lock components as compared to some of the earlier-described embodiments. A manufactured line of cabinets, drawers, doors, etc. can have prescribed types of lock units, with a cam lock, cabinet lock, plunger or other types, and all can be arranged to be engaged with the electronic lock unit 40*a* of the invention. Depths to the different thicknesses of drawers, doors, etc. can be accommodated without providing a series of different shell depths for the shell 94 extending forward from the mechanical cam lock or cabinet lock or other lock unit. The electronic lock unit 40*a* can be universal for many different situations and applications. Note that a single threaded stud 99 is shown in this and other drawings for securing the compact lock to a door, drawer, etc., but any suitable form of attachment can be used. In the case of FIG. 7 the stud 99 or studs (or threaded holes) must be wide enough out from the driver 83 that they will clear the cabinet lock unit 90.

Figure 8:
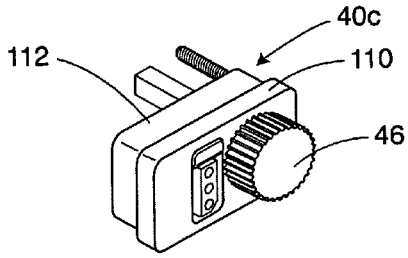
FIG. 8 is a perspective view showing a modified lock device of the invention with provision for recessed mounting.

FIG. 8 shows a modified electronic lock unit 40*c* of the invention, in this case with a flange 110 designed to allow recess mounting of the base part 112 of the housing. The flange 110 may be integrally formed with the base part 112. Thus, the flange 110 is configured to engage against the outside surface of a door or drawer. It should be understood, as pointed out in copending Ser. No. 11/809,172, that the rotatable knob or handle 46 shown in FIG. 8 can be replaced with a lever, which may be needed for handicap access or for other purposes as desired.

Figure 9A:
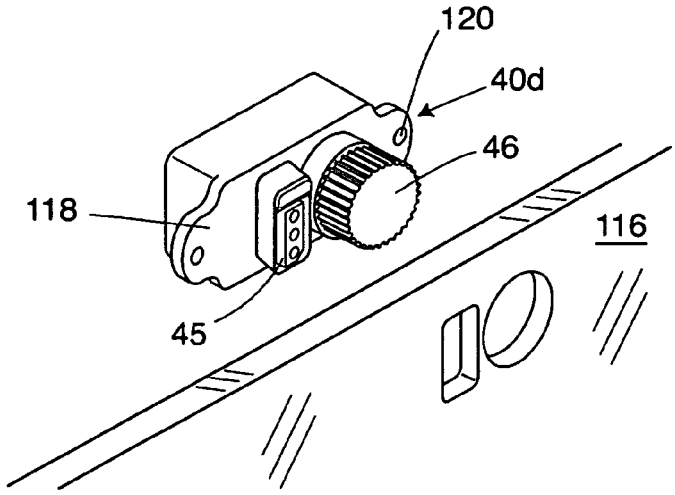
FIGS. 9A to 9C are perspective and cross section views showing a through-panel mounting for an electronic lock of the invention.
Figure 9B:
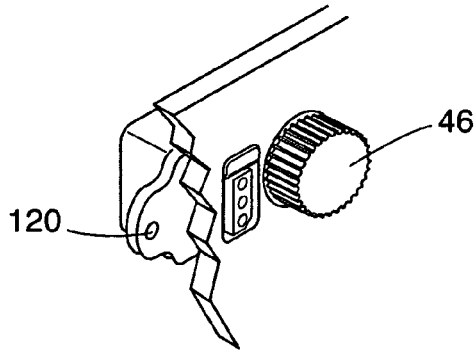
Figure 9C:
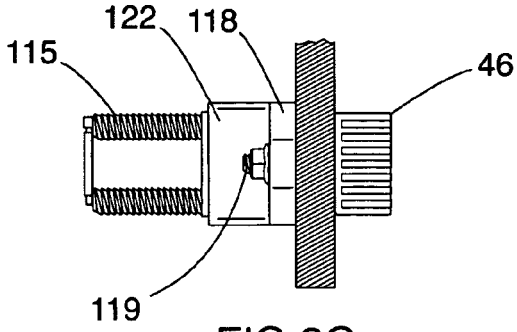

FIGS. 9A through 9C show a self-contained electronic lock unit 40*d* similar to the locks shown above and including a cylinder 115 with an appropriate actuator such as a cam or other latching device, or simply with a driver such as shown at 83 in FIGS. 6 and 7. In this case the electronic lock device 40*d* is mounted behind the panel 116 of a door, drawer, etc. in a through-the-panel mounting, with the knob or handle 46 and the terminal 45 having an adequate mounting depth protruding from a base plate 118 to extend through the thickness of the panel 116, as shown in FIGS. 9B and 9C. The base plate 118 installs flatly against the back side of the panel 116 and is secured by appropriate fasteners 119 through holes 120. The depth to which the knob or handle 46 and the terminal 45 are floated out from the base 118 is matched to the type of panel 116 to which the lock is to be secured (e.g. wood panel, steel panel, etc.). It should be understood that although a cylinder structure is shown in FIG. 9C, this could simply be a cam such as shown at 58 in FIG. 2, or a latch such as shown at 90 in FIG. 7 or another type of engaging device for locking the panel to other structure. Depth concerns may dictate that a cam or latch be provided immediately behind the housing 122 shown in FIG. 9C, without the cylinder structure 115 extending back to increase the depth. A battery compartment (not shown) can be located similarly to what is shown in the locks described above, with a battery door located for maximum convenience. In a low-battery condition a power jump can be made via the terminal 45 as described earlier.

Figure 10A:
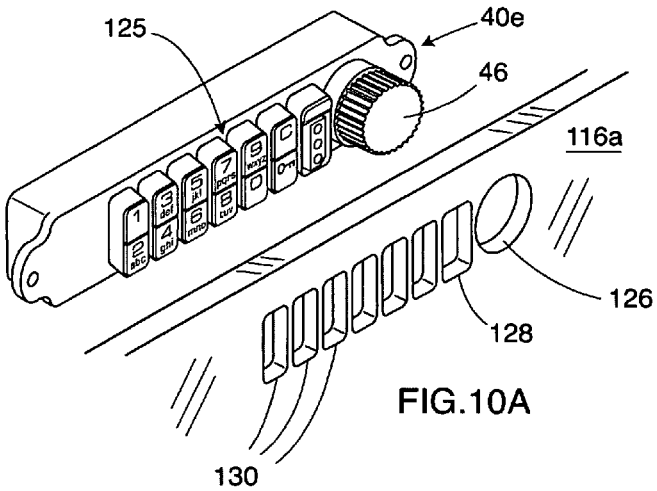
FIGS. 10A to 10C are perspective and cross section views similar to FIG. 9A-9C, showing a modified lock with a keypad.
Figure 10B:
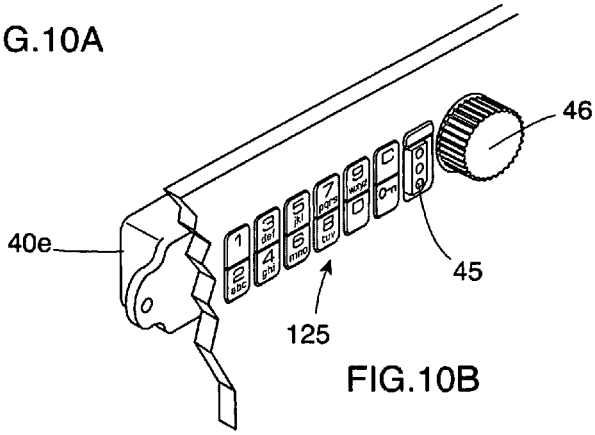
Figure 10C:
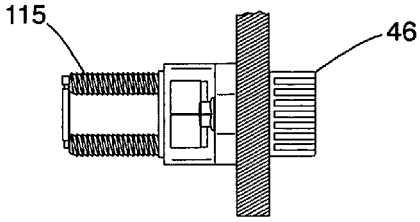
Figure 10D:
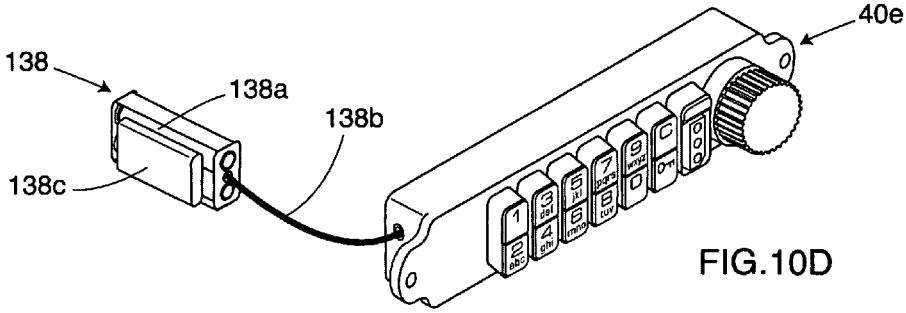
FIG. 10D shows an alternative battery arrangement.

FIGS. 10A through 10C are similar to FIGS. 9A through 9C, but show a keypad 125 on an electronic lock device 40*e*. This lock device 40*e* is similar to embodiments shown in copending application Ser. No. 11/809,172, but with the lock unit mounted behind the panel 116*a* in a through-the-panel mounting, as described with respect to FIGS. 9A-9C. Holes 126, 128 and 130 are provided in the panel for this purpose. Note that the holes 128 and 130 could be replaced by a singular rectangular opening. Again, a different latching or securing mechanism can be included instead of the cylinder structure 115 shown in FIG. 10C, for the reason explained above for FIGS. 9A-9C. FIG. 10D shows that, as an alternative to a battery compartment located accessibly in the housing of the lock 40*e*, the battery can be in a separate battery pack or casing 138 as shown. The battery 138*a* connects to the lock housing by a wire 138*b*; a magnet 138*c* can be provided to mount the battery on a steel panel, or adhesives or Velcro (hook and loop fasteners) can be used.

The term cam lock as used in the claims is intended to refer to a cam lock or cabinet lock, or a plunger lock or switch lock or T handle lock or locks of similar application. Also, references to a knob or handle are to be taken as referring to any type of turning device provided to operate the cam lock manually. Further, reference to a panel of a door, cabinet or drawer is intended to refer to any access panel or a fixed panel from which an openable component is controlled.

The term driver, although used above to refer to the cross-section specific driver 83 in FIGS. 6 through 8, more generally refers to an element that transfers the rotational motion of the knob or handle to the rear of the lock device, which can be through a cylinder, or via a dummy plug or other element, including a cross-section specific driver.

It should also be understood that the manually-operated locks described above could instead be automatic, with electromagnetic operation to retract a latch or rotated cam, such as a solenoid or miniature motor.

Figure 11:
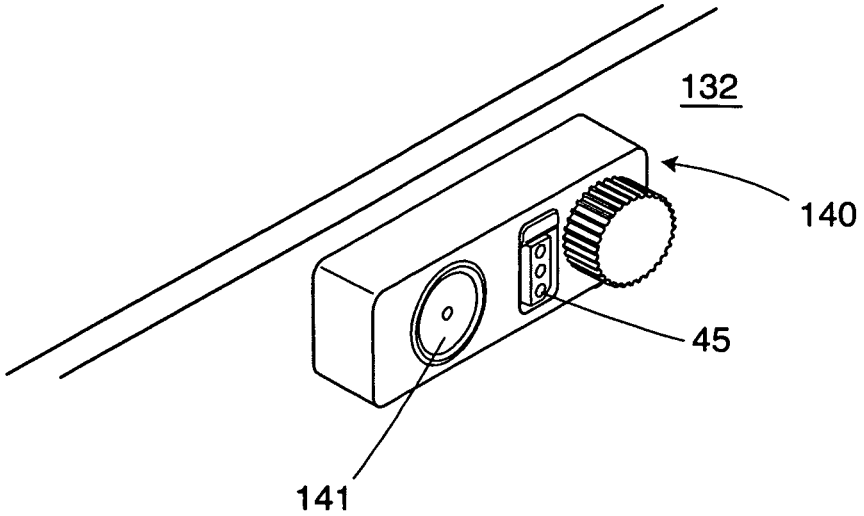
FIG. 11 is a perspective view showing a lock device of the invention with a key reader and an IButton reader.

FIG. 11 shows a panel with another application of a compact lock 140 of the invention, similar to that of FIG. 5C but with the additional input device 141 designed to receive an IButton input, which can be the primary means of accessing the lock.

Figure 12:
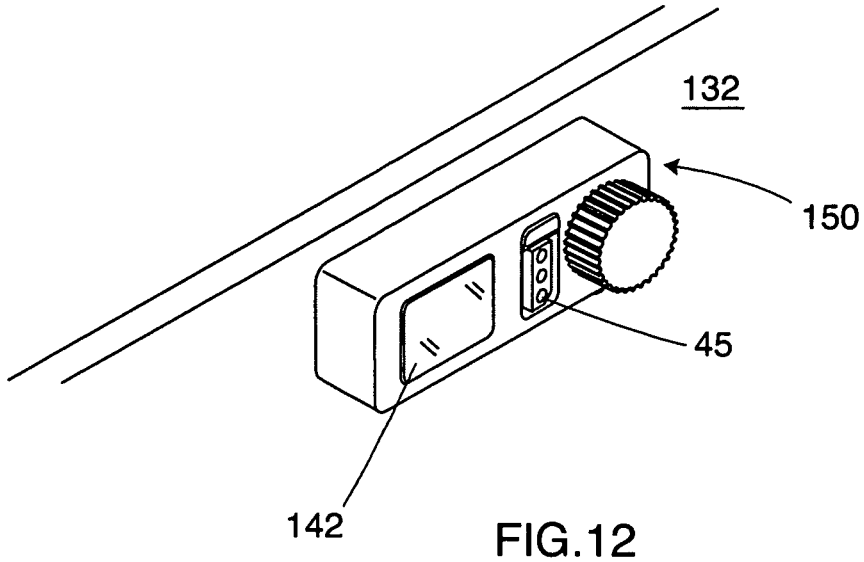
FIG. 12 is a perspective view showing a lock device of the invention with a key reader and a wireless reader.
Figure 15:
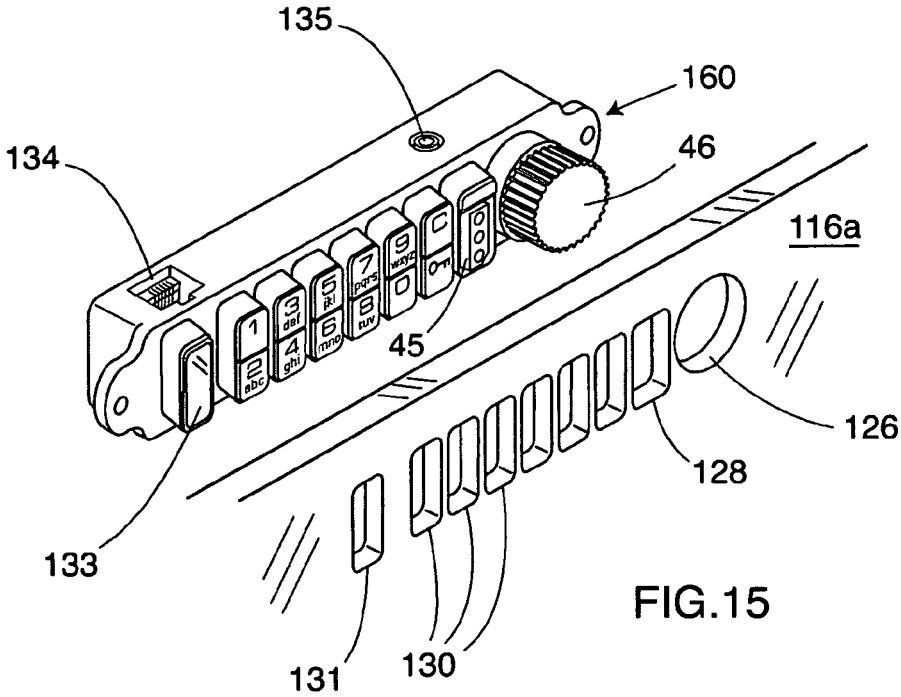
FIG. 15 is the same lock device shown in FIG. 10A but with the addition of a network antenna, network jack receptacle and external power port.
Figure 16:
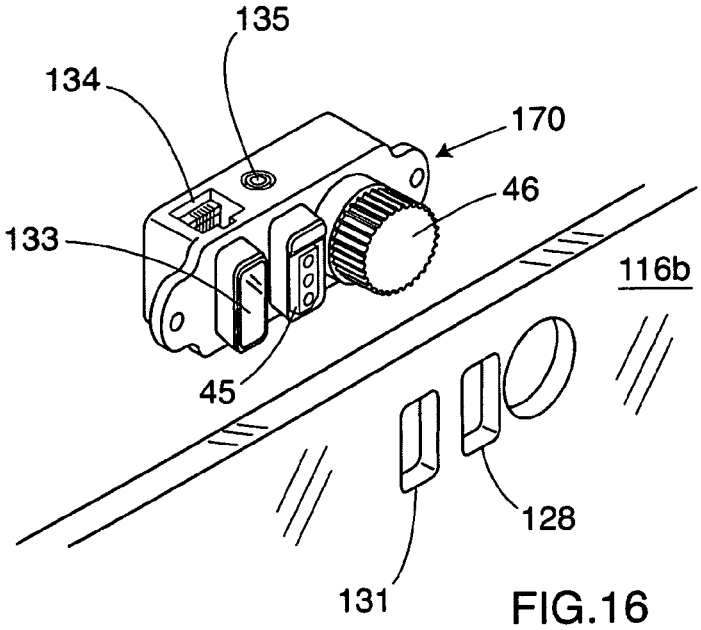
FIG. 16 is the same lock device shown in FIG. 9A but with the addition of a network antenna, network jack receptacle and external power port.

FIG. 12 shows another application of a compact lock 150 of the invention, similar to that of FIG. 5C but with an additional input device 142 designed to receive wireless input from wireless access credentials such as RFID tags, proximity access cards and other wireless access technologies. The wireless technologies are commonly used for accessing the lock devices of the invention, reducing the number of credentials the user has to carry. Additionally the lock devices may be fitted with Bluetooth or similar interfaces to communicate with handheld small computers, PDAs or mobile telephones for access as well as uploading and downloading data to and from the lock devices. This data may be access programming data or data containing audit trail or usage information as well as application specific data for the usage of the cabinet such as insertion or removal of files or other items to and from the cabinet. FIGS. 15 and 16 also show the lock device of the invention with an antenna 133 for wireless network connection. This connection may be an Ethernet connection or Bluetooth or similar connection or both. The lock units 160 and 170 shown in FIGS. 15 and 16 (similar to those of FIGS. 10A and 9A) are also equipped with a receptacle 134 for direct network connection (as an alternative to wireless) as well as a power receptacle 135 for external (line) power if required or desired. A network can be used to control what codes have access to a series of cabinets, drawers, etc. Such a network will include a terminal or central control system which can simply be a microprocessor with a database listing all locks. A laptop or hand held computer device is all that is required. With the central control a manager connects to any one lock or all locks when desired, to update which "keys" or codes will have access, and even the times of permitted access if desired. Each lock can include a processor to receive the control signal and to set the lock's electronics to allow access by employees A, B, C and D but not employee E, for example. This is changeable at any time, instantly. The programming and electronics for this networking and control function are well within the ability of a person of ordinary skill in the art. A panel hole 131 is provided for the antenna 133. A single panel opening could be provided for all projecting elements, or one for the antenna, one for all keys and the terminal 45, and one for the knob, or other similar arrangements. Note that the antenna and/or direct network receptacle, as well as the line power connection 135, can be included on any of the embodiments described above.

FIGS. 13 and 14 show panels 132*a* and 132*b* with lock devices 140*a* and 150*a* similar to those shown in FIGS. 11 and 12 but configured for installation through the panel of the door, cabinet or drawer. In this case the battery access will be from behind the lock device. The lock is mounted to studs on the panel through the mounting holes at each end or the unit may be mounted with screws or other fasteners directly to the panel from behind. Note again that common openings rather than individual holes can be provided in the panel for the knob, terminal, and input device.

Figure 17:
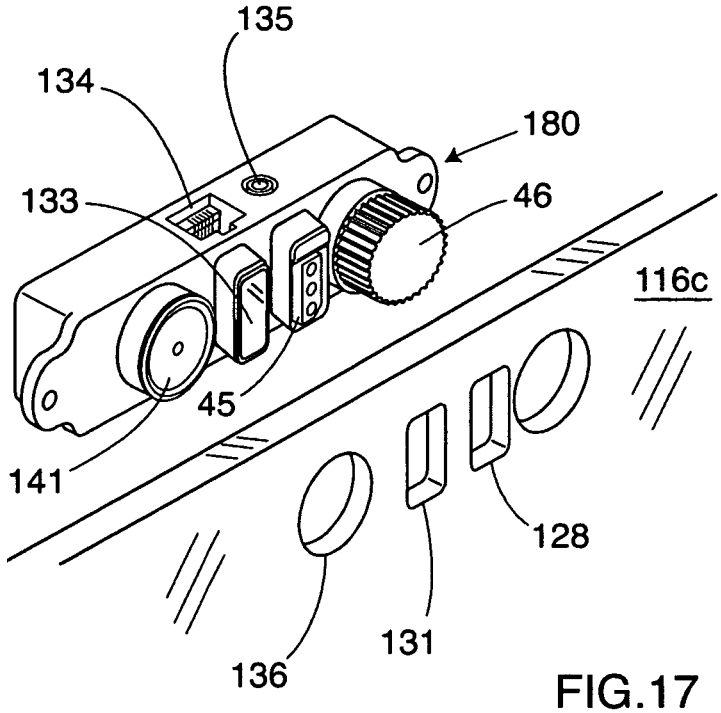
FIG. 17 is the same lock device shown in FIG. 13 but with the addition of a network antenna, network jack receptacle and external power port.
Figure 18:
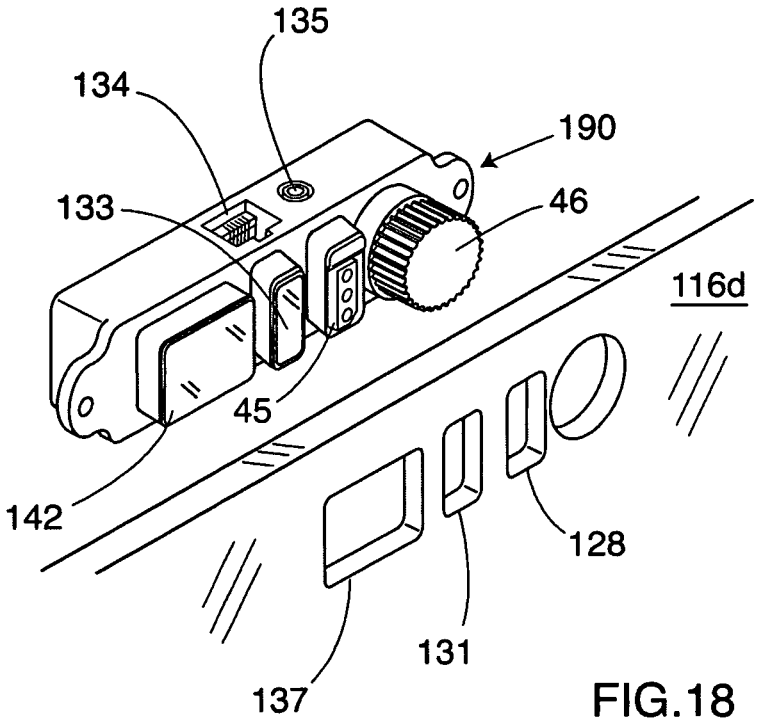
FIG. 18 is the same lock device shown in FIG. 14 but with the addition of a network antenna, network jack receptacle and external power port.

FIGS. 17 and 18 show through-the-panel lock devices 180 and 190 as shown in FIGS. 13 and 14 fitted with the same apparatus for network and power connections 134 and 135 (and antenna 135 if needed) discussed above for FIGS. 15 and 16.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. An electronic cam lock on a door, cabinet, panel or drawer in a cabinet or furniture that provides ingress and no egress without a mechanical key, comprising:

a compact housing containing electronics and having a terminal enabling entry of a code by a user, such code when properly entered causing the electronics to permit access, the housing being positioned on and affixed to a panel of said door or other structure of said cabinet or furniture to which the lock is affixed, a cam lock cylinder unit extending from a back side of the housing, in a standard cam lock size, fitting a standard cam lock opening in the panel and extending therethrough, with a lock driver in the cylinder unit, engaged with a latch device at the inside of the door or panel of said cabinet or furniture, and including a knob or handle on the housing for operating the lock manually without a mechanical key to rotate the lock driver when permitted by the electronics, and a power source connected to power the electronics.

2. The electronic cam lock of claim 1, the power source comprising batteries, and the terminal having three electrical contacts such that a user key will engage with two of the contacts to access the lock, and a third contact being provided for use of a special key with a battery to supply power to the lock in the event of a low battery condition in the lock's batteries.

3. The electronic cam lock of claim 1, wherein the housing has dimensions no greater than about two inches in width, about ⅞ inches in height and about ⅝ inch in thickness.

4. The electronic cam lock of claim 1, wherein the housing is positioned on the front side of the panel of said cabinet or furniture.

5. The electronic cam lock of claim 1, wherein the power source comprises a battery pack separate from the housing and wired into the housing, with mounting means on the battery pack for securing to structure at the back side of the door or panel.

6. The electronic cam lock of claim 1, wherein the housing further includes an external power terminal for line power.

7. The electronic cam lock of claim 1, wherein the housing further includes a receptacle for direct network connection.

8. The electronic cam lock or claim 1, wherein the housing further includes an antenna for wireless network connection.

9. The electronic cam lock of claim 1, wherein the housing further includes an input for an IButton or wireless access user credential for a user's inputting a code to the lock.

10. An electronic cam lock on a door, cabinet, panel or drawer in a cabinet or furniture that provides ingress and no egress without a mechanical key, comprising:

a compact housing containing electronics and having a terminal enabling entry of a code by a user, such that the code when properly entered will cause the electronics to permit access, the housing being positioned on and affixed to a front side of said panel or other structure of said cabinet or furniture to which the lock is to be affixed, a cam lock cylinder unit extending from a back side of the housing, in a standard cam lock size, fitting a standard cam lock opening in the panel and extending therethrough, with a lock driver in the cylinder unit, engaged with a latch device at the inside of the door or panel, and including a knob or handle on the housing for operating the lock manually without a mechanical key to rotate the lock driver when permitted by the electronics, and the housing being without batteries, and the terminal including a contact for receiving power from a key device that contains a battery.

11. The electronic cam lock of claim 10, wherein the terminal has electrical contacts, and further including a key device with a battery and with contacts adapted to fit with the terminal and to make contact with the electrical contacts of the terminal.

12. The electronic cam lock of claim 10, wherein the lock driver has a non-circular cross sectional shape adapted to be received in a mechanical latch device affixed to a back side of the panel of a door or other openable structure to which the lock is to be affixed, with the housing affixed to a front side of the panel.

13. The electronic cam lock of claim 1, wherein the terminal comprises a reader for a wireless access user credential.

14. The electronic cam lock of claim 1, wherein the terminal comprises a reader for a card carrying an RFID tag.

15. The electronic cam lock of claim 1, wherein the terminal comprises for an RFID reader for wireless communication with handheld small computers, PDAs or mobile telephones.

16. The electronic cam lock of claim 1, wherein the housing includes a battery compartment, the power source comprising one or more batteries contained in the battery compartment for operating the electronics, and the battery compartment being positioned to be accessible when the housing is secured against a door.

17. The electronic cam lock of claim 1, wherein the housing has dimensions no greater than about ⅞ inches in height and about ⅝ inch in thickness.

18. The electronic cam lock of claim 17, wherein the cabinet or furniture comprises a metal file cabinet, and wherein the cam lock is installed on a narrow margin area of the metal file cabinet.

19. An electronic cam lock on a door, cabinet, panel or drawer in a cabinet or furniture that provides ingress and no egress, comprising:

a compact housing containing electronics and having a terminal enabling entry of a code by a user, such code when properly entered causing the electronics to permit access, the housing being positioned on a panel of said door or other structure of said cabinet or furniture to which the lock is affixed, a lock driver extending from a back side of the housing, engaged with a latch device at the inside of the door or panel of said cabinet or furniture, the lock driver comprising a blank cylinder plug extending back from the housing, the blank cylinder plug being adapted to fit into a cylinder shell mounted in said door or panel, and including a knob or handle on the housing for operating the lock manually to rotate the lock driver when permitted by the electronics, and a power source connected to power the electronics.

20. An electronic cam lock on a door, cabinet, panel or drawer in a cabinet or furniture that provides ingress and no egress, comprising:

a compact housing containing electronics and having a terminal enabling entry of a code by a user, such code when properly entered causing the electronics to permit access, the housing being positioned on a panel of said door or other structure of said cabinet or furniture to which the lock is affixed, a lock driver extending from a back side of the housing, engaged with a latch device at the inside of the door or panel with a knob or handle on the housing for operating the lock manually to rotate the lock driver when permitted by the electronics, the lock driver comprising a cylinder plug which is rotated when the knob or handle is permitted to rotate, the plug being engaged within a cylinder mounted on a panel of the door or panel to which the lock is affixed, and the housing being without batteries, and the terminal including a contact for receiving power from a key device that contains a battery.

* * * * *

UNITED STATES PATENT AND TRADEMARK OFFICE

CERTIFICATE OF CORRECTION

PATENT NO. : 8,490,443 B2
APPLICATION NO. : 12/214357
DATED : July 23, 2013
INVENTOR(S) : Asil T. Gokcebay It is certified that error appears in the above-identified patent and that said Letters Patent is hereby corrected as shown below:

In the Claims

Column 10, line 37 (Claim 15, line 2) delete "for an RFID" and insert --a--.

Signed and Sealed this
Fifteenth Day of October, 2013

Teresa Stanek Rea
*Deputy Director of the United States Patent and Trademark Office*